US005629713A

United States Patent [19]

Mailandt et al.

[11] Patent Number: 5,629,713

[45] Date of Patent: May 13, 1997

[54] HORIZONTALLY POLARIZED ANTENNA ARRAY HAVING EXTENDED E-PLANE BEAM WIDTH AND METHOD FOR ACCOMPLISHING BEAM WIDTH EXTENSION

[75] Inventors: Peter Mailandt, Dallas; Tan D. Huynh, Hurst, both of Tex.

[73] Assignee: Allen Telecom Group, Inc., Solon, Ohio

[21] Appl. No.: 443,148

[22] Filed: May 17, 1995

[51] Int. Cl.[6] ..... H01Q 19/10

[52] U.S. Cl. ..... 343/808; 343/817; 343/818; 343/792.5

[58] Field of Search ..... 343/808, 810, 343/812, 813, 815, 817, 818, 795, 797, 792.5

[56] References Cited

U.S. PATENT DOCUMENTS

| | | | |
|---|---|---|---|
| 2,937,374 | 5/1960 | Cork | 343/808 |
| 3,466,655 | 9/1969 | Mayes et al. | 343/815 |
| 3,530,484 | 9/1970 | Barbano et al. | 343/810 |
| 3,541,559 | 11/1970 | Evans | 343/795 |
| 3,696,437 | 10/1972 | Grant | 343/810 |
| 4,290,071 | 9/1981 | Fenwick | 343/815 |
| 4,812,855 | 3/1989 | Coe et al. | 343/700 MS |

*Primary Examiner*—Donald T. Hajec
*Assistant Examiner*—Tan Ho

[57] ABSTRACT

A horizontally polarized antenna array having extended E-plane beam width, and a method for accomplishing beam width extension. In one embodiment of the invention, an antenna array is provided that comprises a driven dipole element mounted to a conductive means forming a ground plane, the driven dipole element having opposing arms, and a pair of collinear parasitic dipole elements disposed on opposite sides of the driven dipole element, the parasitic dipole elements having opposing arms inclined toward the ground plane such that the opposing arms of each parasitic dipole element are perpendicular to one another.

24 Claims, 10 Drawing Sheets

FIG. 7(a)
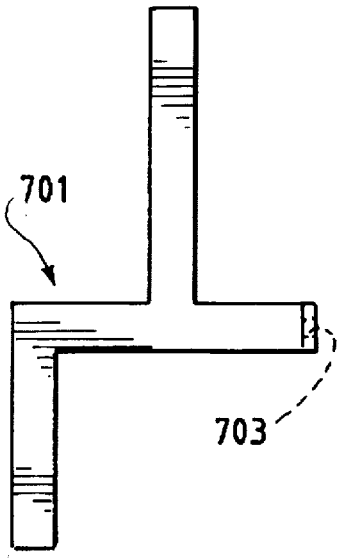
FIG. 7(b)
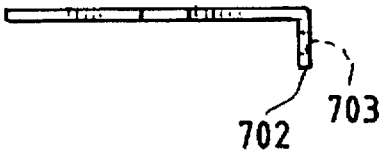
FIG. 8(b)
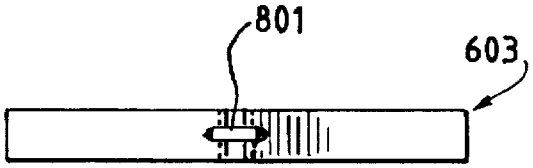
FIG. 8(c)
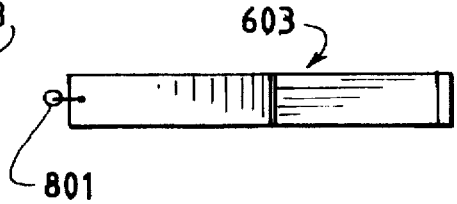
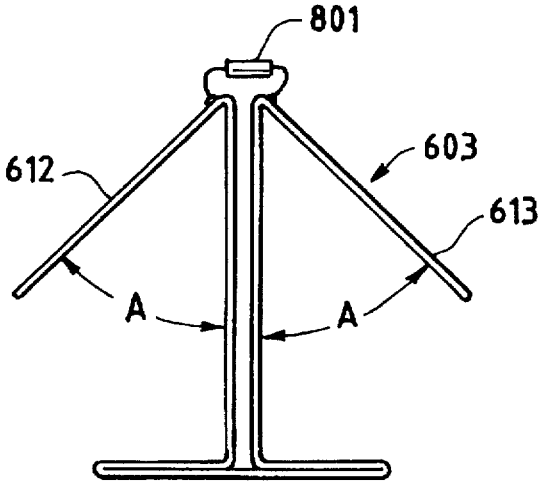
FIG. 8(a)

HORIZONTALLY POLARIZED ANTENNA ARRAY HAVING EXTENDED E-PLANE BEAM WIDTH AND METHOD FOR ACCOMPLISHING BEAM WIDTH EXTENSION

FIELD OF THE INVENTION

This invention relates generally to antennas and in particular to a horizontally polarized antenna array, and is more particularly directed toward a horizontally polarized antenna array having extended E-plane beam width.

BACKGROUND OF THE INVENTION

There are many different types of antennas designed for operation with RF (radio frequency) communication systems. Many such antennas exhibit gain and directivity characteristics that make them particularly suitable for specific applications.

Requirements for gain and directivity are often dictated by coverage desired in a particular application. For a conventional community repeater installation, as is well-known in the art, an antenna system having an omnidirectional pattern is most often utilized. Of course, terrain features or man-made obstructions can influence antenna choice, and a directional antenna is often employed when the desired coverage area is irregular in shape, or it is impossible to deploy an antenna near the center of the desired coverage area.

Cellular telephone systems often prove particularly challenging to antenna designers and system planners alike. Since most cellular systems were initially deployed in urban areas, most system planners have had to contend with obstructions in one or more cells due to tall buildings. These types of obstructions generally give rise to irregularly shaped cells and/or antenna deployment in areas outside the cell center.

Obstructions are in part responsible for some of the anomalous signal propagation that is characteristic of the 800 MHz (megahertz) spectrum. Other propagation difficulties are created by frequency-selective fading, multipath, and doppler effect, as is well-known in the art. Cell sectoring and diversity are often used to help combat these problems.

In cell sectoring, a cell is divided into sectors of 120 degrees, for example (60 degree sectors are also used). Antennas with selected gain/directivity characteristics are used to cover selected sectors of a cell. Usually, these sector antennas are used for receiving by the cell site, with an omnidirectional antenna used for transmitting throughout the cell. A dedicated transmitting antenna can also be used for each sector.

At least two types of diversity are also used to improve cell site performance. Spatial diversity can be implemented by positioning two receive antennas, physically displaced from one another, for each cell site. If one antenna is subject to a fading phenomenon, the other antenna may not be.

Polarization diversity is also a popular tool. In polarization diversity, two cell site antennas are provided in each sector for receiving, with each antenna having a different polarization (one vertical and one horizontal, for example, or one circular and one linear). One antenna per sector is generally provided for transmitting.

In order to take advantage of both spatial and polarization diversity in a sectored cell, an antenna system is required that possesses the requisite polarization and directivity characteristics. The horizontal beam width should be extendable to 120 degrees to ensure adequate coverage in each sector of a three-sector cell. Accordingly, a need arises for a horizontally polarized antenna array providing extended horizontal beam width. The antenna array should be easily combined with a vertical array to create a composite antenna, and should be durable, easily mountable, and relatively economical to manufacture.

SUMMARY OF THE INVENTION

These needs and others are satisfied by the horizontally polarized antenna of the present invention, which comprises a driven dipole element mounted to a conductive means forming a ground plane, the driven dipole element having opposing arms, and a pair of collinear parasitic dipole elements disposed on opposite sides of the driven dipole element, the parasitic dipole elements having opposing arms inclined toward the ground plane such that the opposing arms of each parasitic dipole element are perpendicular to one another.

The antenna array operates at an operating frequency, and each of the opposing arms of the driven dipole element is approximately one-quarter wavelength in electrical length at the operating frequency. Each of the opposing arms of the parasitic dipole elements is approximately one-quarter wavelength in electrical length at the operating frequency, and each parasitic dipole element is spaced approximately one-half electrical wavelength from the driven dipole element. The opposing arms of each parasitic dipole element are connected by a resistor, and, in one form of the invention, the resistor has a value between 45 and 55 ohms. In another form of the invention, the resistor has a value between 25 and 35 ohms.

In one embodiment of the invention, the antenna array comprises a horizontally polarized antenna array having an E-plane 3 dB beam width of approximately 90 degrees. In another embodiment, the opposing arms of the driven dipole element are inclined toward the ground plane to form an angle therebetween. The angle formed between the opposing arms of the driven dipole element may be approximately 120 degrees. In this embodiment, the antenna array comprises a horizontally polarized antenna array having an E-plane 3 dB beam width of approximately 105 degrees.

In a further embodiment, the angle formed between the opposing arms of the driven dipole element may be approximately 90 degrees. In this embodiment, the antenna array comprises a horizontally polarized antenna array having an E-plane 3 dB beam width of approximately 120 degrees.

In one form of the invention, a composite antenna array comprises a vertically polarized antenna array including a plurality of vertically polarized antennas mounted to a conductive means forming a ground plane, the vertically polarized antennas sharing a common first orientation, and a horizontally polarized antenna array including a plurality of subarrays, with each of the subarrays comprising a driven dipole element mounted to the conductive means forming the ground plane, the driven dipole element having opposing arms inclined toward the ground plane to form an angle therebetween, a pair of collinear parasitic dipole elements disposed on opposite sides of the driven dipole element, the parasitic dipole elements having opposing inclined toward the ground plane such that the opposing arms of each parasitic dipole element are perpendicular to one another, with the driven dipole element and the parasitic dipole elements sharing a common second orientation orthogonal with the first orientation. Each of the antennas of the vertically polarized antenna array comprises a log periodic dipole array. The vertically polarized antenna array comprises four vertically polarized antennas in one embodiment, while the vertically polarized antenna array comprises eight vertically polarized antennas in another embodiment. The horizontally polarized antenna array may comprise four subarrays or eight subarrays, for example. The composite antenna array further includes an antenna support structure for supporting the antenna array in an operating orientation. The operating orientation comprises an orientation in which the ground plane is substantially perpendicular to the earth's surface.

In accordance with the invention, a method is provided for extending 3 dB E-plane beam width of a horizontally polarized antenna array. The method comprising the steps of mounting a driven dipole element to a conductive means forming a ground plane, the dipole element having opposing arms forming an angle therebetween, disposing a pair of collinear parasitic dipole elements on opposite sides of the driven dipole element, the parasitic dipole elements having opposing arms inclined toward the ground plane such that the opposing arms of each parasitic dipole element are perpendicular to one another, and decreasing the angle between the opposing arms of the driven dipole element to extend 3 dB E-plane beam width of the antenna array while controlling mutual coupling. In one form, the opposing arms of the parasitic dipole elements are connected by an electrical resistance, and the method further comprises the step of decreasing the electrical resistance to extend 3 dB E-plane beam width while controlling mutual coupling.

BRIEF DESCRIPTION OF THE DRAWINGS

FIG. 6(*b*) is a side elevational view of the composite antenna of FIG. 6(*a*);

FIG. 6(*c*) is an end elevational view of the composite antenna;

FIG. 6(*d*) is an end view of the composite antenna array illustrating an alternative geometry for the driven dipole element of the horizontally polarized subarray;

FIG. 6(*e*) shows yet another configuration for the driven dipole element of the horizontally polarized subarray;

FIG. 6(*f*) depicts a composite antenna array having additional elements;

FIGS. 7(*a*) and 7(*b*) illustrate construction of the elements of the vertically polarized array in accordance with the present invention;

FIGS. 8(*a*)–8(*c*) show the construction of the parasitic dipole elements of the horizontally polarized antenna array in accordance with the present invention;

FIG. 12(*b*) is a side elevational view of the protective cover of FIG. 12(*a*);

DETAILED DESCRIPTION OF THE INVENTION

In accordance with the present invention, a horizontally polarized antenna array and method for extending E-plane beam width are described that provide distinct advantages when compared to those of the prior art. The invention can best be understood with reference to the accompanying drawing figures.

Figure 1:
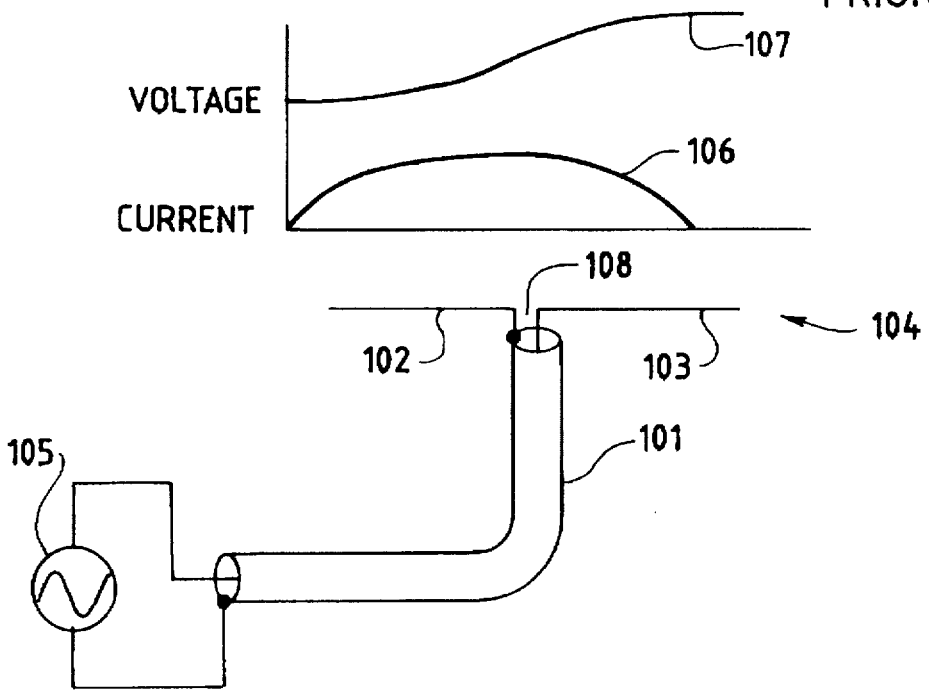
FIG. 1 PRIOR ART
FIG. 1 is a side elevational view of a coaxial transmission line terminated in an electric dipole antenna.

In much the same way that acoustic energy (sound) can be allowed to escape from an acoustic waveguide to radiate into space, an electromagnetic wave can be allowed to escape from a transmission line in a similar radiation phenomenon. FIG. 1 illustrates one prior art method for realizing this radiation phenomenon with electromagnetic waves by terminating a coaxial line 101 with two wires 102, 103 parallel to each other, but extending in opposite directions, thereby creating an electric dipole antenna 104. The configuration shown is called a center-fed dipole.

The coaxial line 101 is connected to a source of RF voltage 105, and the relationship between current and voltage along the dipole is also depicted in the figure. Note that current 106 is at its minimum value near the ends of the dipole 104, while voltage 107 is maximized at the ends. Voltage 107 has its minimum value near a point corresponding to the feed point 108 of the antenna 104.

A dipole antenna that is electrically one-half wavelength long ($\lambda/2$) is called a half-wave resonant dipole. An antenna of this type has been tuned so that its impedance is resistive (rather than reactive) at its operating frequency. A typical dipole is oriented so that its longitudinal axis is parallel to the Earth's surface. This configuration results in a horizontally polarized antenna.

Polarization of a $\lambda/2$ dipole is the same as the direction of its axis. The electromagnetic field that is radiated from a dipole antenna has both a magnetic field component and an electric field component, with the electric field being parallel to the antenna's axis. Thus, polarization direction for a dipole antenna is the same as the orientation of the electric field component of the radiated electromagnetic wave.

The electric field and magnetic field are always perpendicular to one another, or, in other words, in a transverse relationship. Thus, such an electromagnetic wave is called a transverse electromagnetic wave, or TEM wave. In fact, as an electromagnetic wave propagates through free space, its value is uniform throughout any plane perpendicular to its direction of propagation. So, a TEM wave propagating through free space is termed a uniform plane wave. At distances relatively far from the antenna, this uniform plane wave approximation holds.

Figure 2:
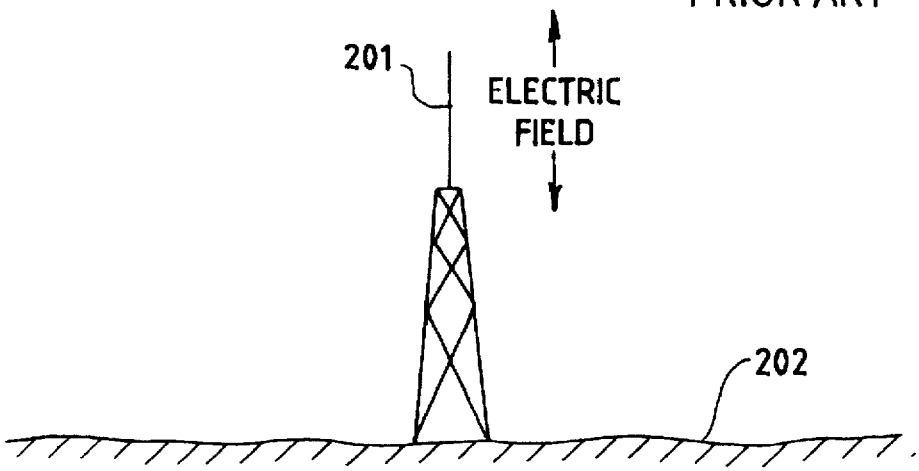
FIG. 2 PRIOR ART
FIG. 2 illustrates a half-wave dipole antenna oriented vertically.

FIG. 2 depicts a prior art half-wave dipole 201 that is oriented vertically, so that the antenna is perpendicular to the Earth's surface 202. This is a vertically polarized configuration. The direction of polarization can also be thought of as the direction of the electric field with respect to the Earth, as shown in the figure. The configuration of FIG. 2 is often adopted for conventional RF communication systems where obstructions are of no particular concern, and where the antenna can be placed near the center of the coverage area.

Figure 3:
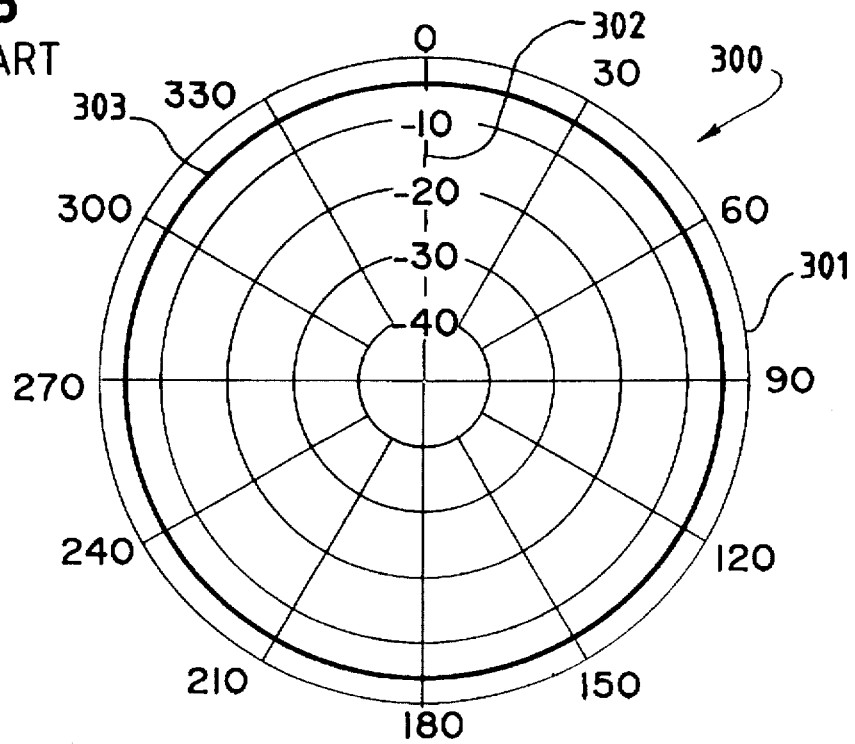
FIG. 3 PRIOR ART
FIG. 3 is a radiation pattern plot for a vertical antenna.

FIG. 3 is a radiation pattern plot, generally depicted by the numeral 300, for the prior art vertical antenna illustrated in FIG. 2. A typical plot of this kind uses a polar coordinate system 301, with relative values of the logarithm of the radiated signal voltage 302 graduated in decibels (dB). This is called a linear decibel grid. As shown in FIG. 3, the radiation pattern 301 of a vertically oriented dipole, in the H or magnetic field plane that is parallel to the surface of the Earth, is circular. That is, the antenna is omnidirectional, since it radiates about equally well in all azimuth directions.

Figure 4:
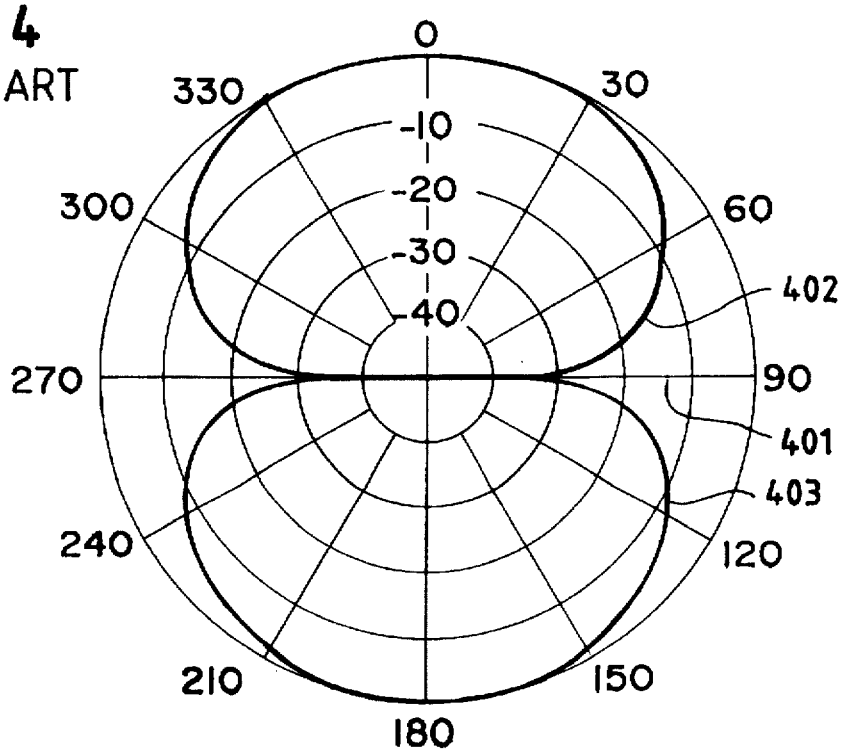
FIG. 4 PRIOR ART
FIG. 4 shows the radiation pattern of a horizontally oriented half-wave dipole antenna.

A horizontally oriented dipole, however, does not display this same circular radiation pattern. FIG. 4 is the radiation pattern of a horizontal dipole, such as the prior art antenna illustrated in FIG. 1. For purposes of the radiation pattern of FIG. 4, the horizontal dipole is oriented along the horizontal axis 401 of the plot. The radiation pattern, which in this case would be the E-plane (electric field plane) azimuth pattern, has two distinct lobes 402, 403. These lobes are present because a horizontally oriented dipole simply does not radiate well from the ends of the antenna.

By using groups of elements with different orientations, different overall polarizations can be achieved. For example, if horizontally polarized and vertically polarized elements are used in the same plane, and designed to radiate in phase, the resultant polarization will be linear, a name given to polarization that is tilted between horizontal and vertical. If the horizontal and vertical elements are fed out of phase (with the phase difference not an integral multiple of one-half wavelength), elliptical polarization will result. This polarization can be made circular with proper phase adjustment (90 degree phase difference).

Directivity of an antenna refers to the fact that an antenna radiates more strongly in some directions than in others. In order to increase the gain and control the directivity of an antenna, groups of antennas may be used together. These are called multielement antenna arrays, and there are many different types having varied characteristics.

Figure 5:
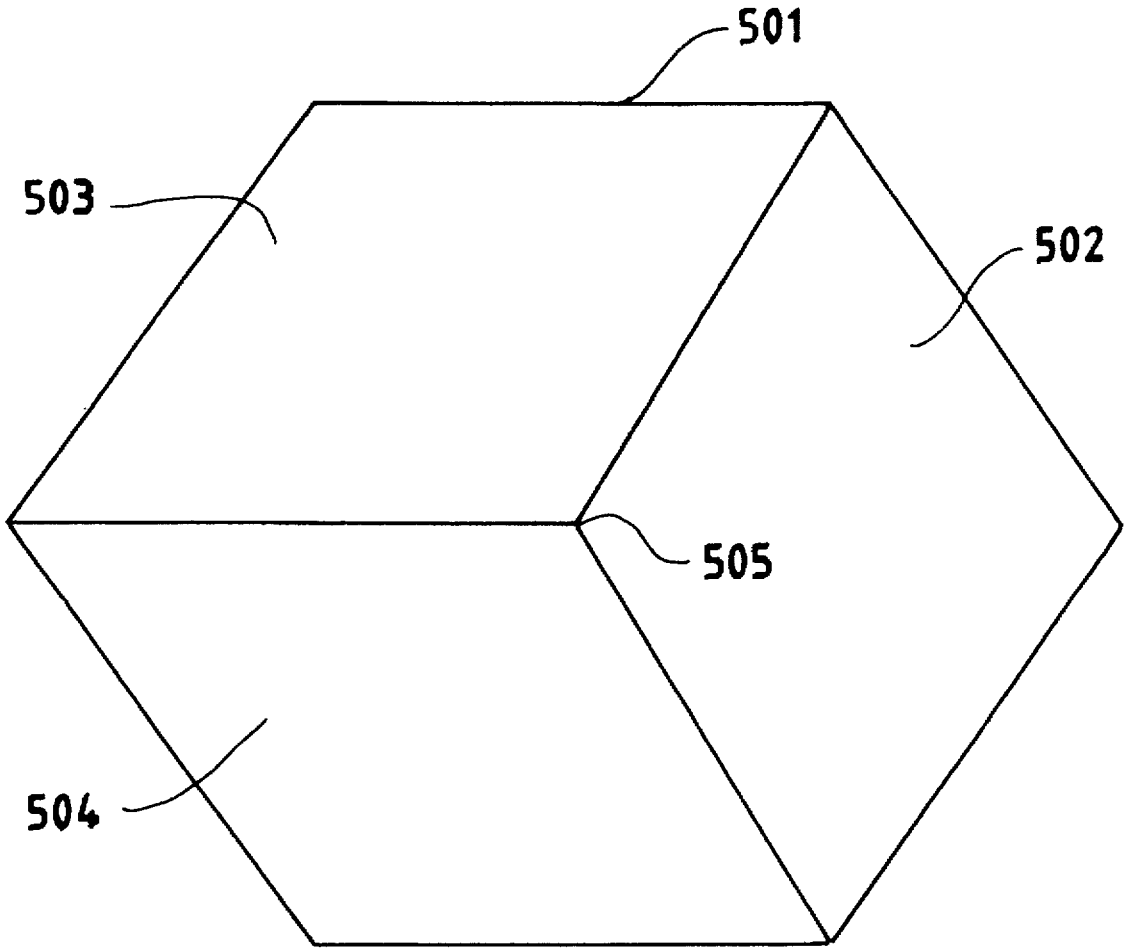
FIG. 5 depicts a cell of a typical cellular telephone communication system.
Figure 6A:
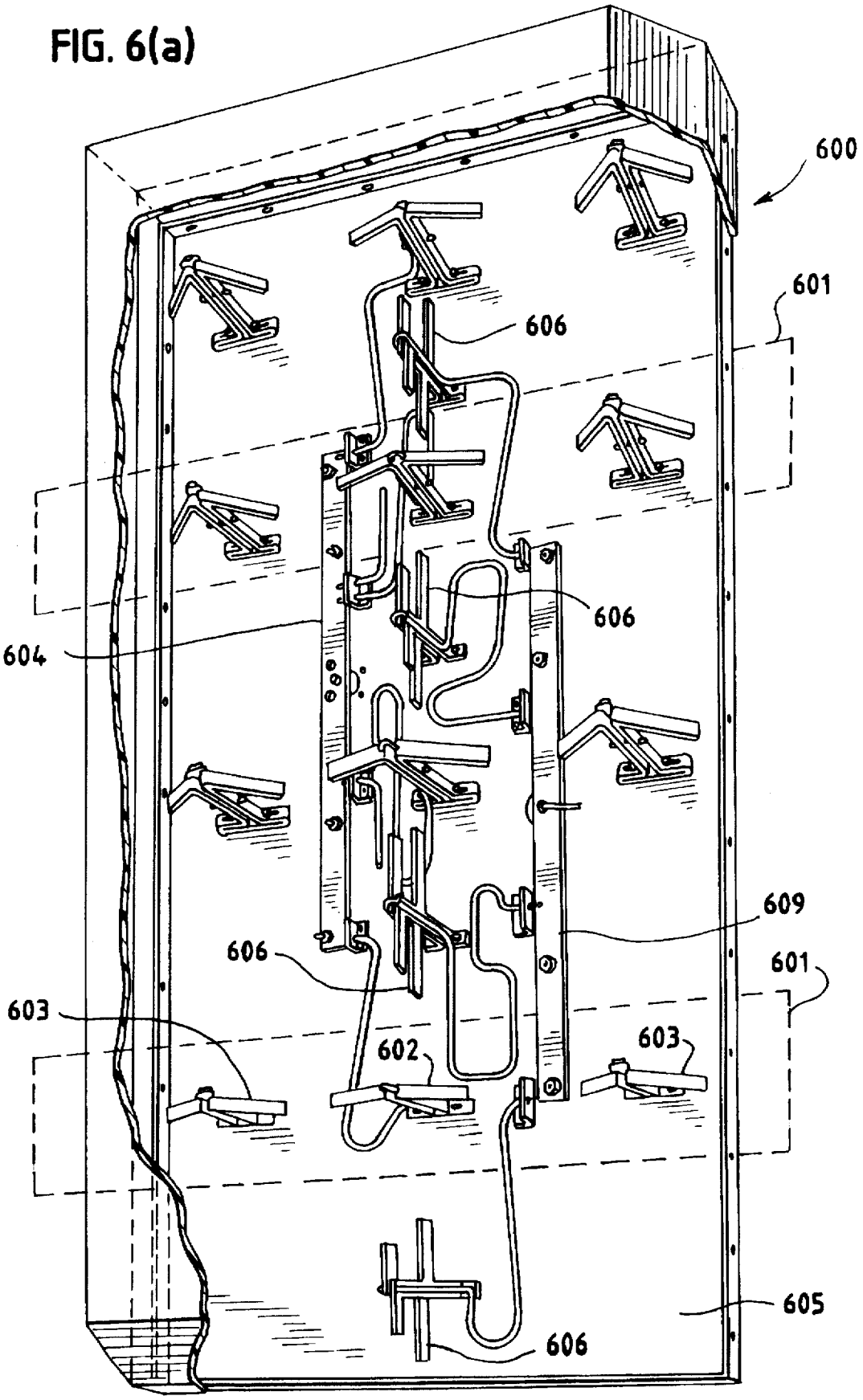
FIG. 6(*a*) is a perspective view of a specially arrayed composite antenna in accordance with the present invention, with a portion of its protective cover cut away.
Figure 6C:
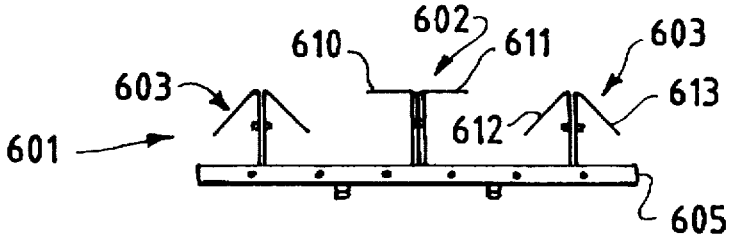
Figure 6B:
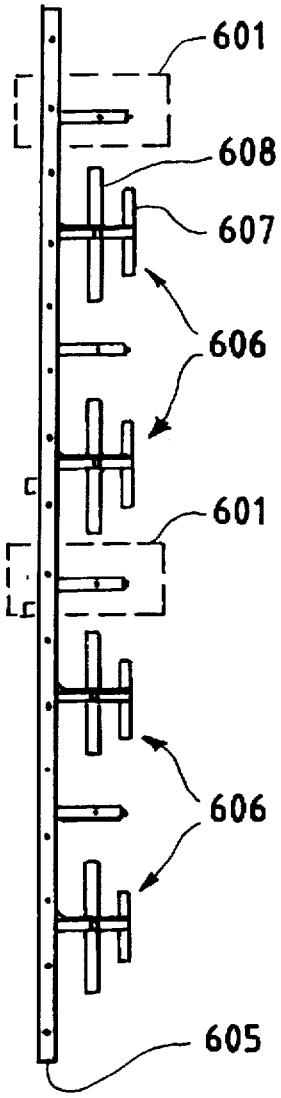
Figure 6D:
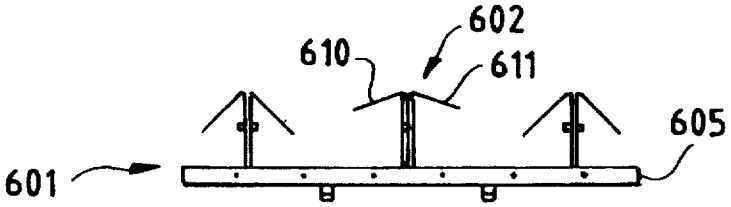
Figure 6E:
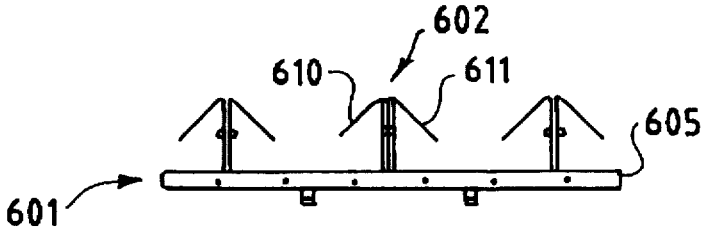
Figure 6F:
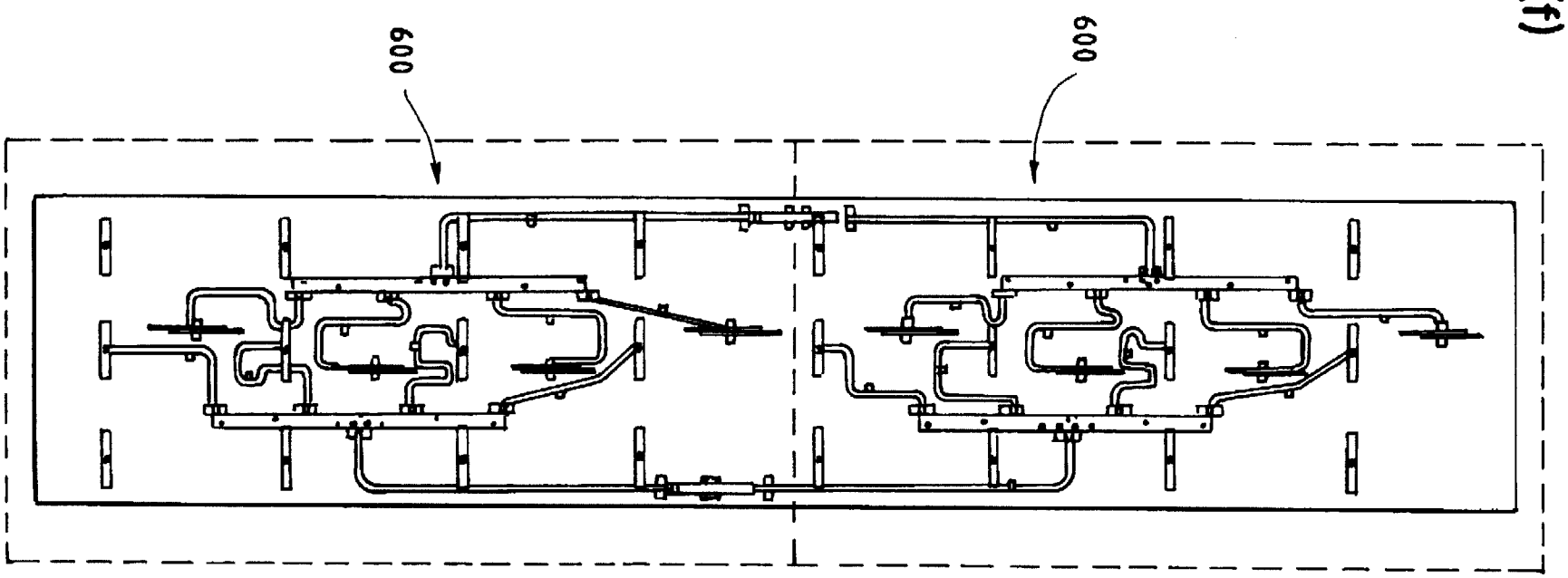

As discussed previously, circular or nearly circular radiation patterns are not appropriate for all systems. In cellular systems in particular, it has often been necessary to provide directional antenna systems in order to subdivide cells into sectors. FIG. 5 illustrates a cell 501 of a typical cellular telephone communication system. It is customary to depict the cells 501 of a cellular system as hexagons, as shown, since a pattern of hexagons fits together very well to represent a coverage area made up of a number of individual cells.

Due to various coverage issues influenced by such things as obstructions in urban cellular systems, congestion, and the relatively low transmitter power levels of portable cellular units, a cell 501 will frequently be divided into sectors. FIG. 5 shows a cell 501 divided into three sectors 502–504 of equal size. It is desirable to place a cell site antenna system near the center 505 of the cell.

For the sector arrangement illustrated in FIG. 5, an omnidirectional antenna would normally be provided at the cell center 505 for transmit purposes. Of course, an antenna with an omnidirectional radiation pattern would be ideally suited for such an application. Each individual sector 502–504 would then be equipped with a directional antenna for receiving purposes. From an inspection of the geometry of the sectored cell 501, it is clear that each sector receive antenna should have a horizontal beam width of about 120 degrees to ensure coverage of each sector without unnecessary overlap.

Of course, other considerations also influence the selection of antenna configuration. Because of other propagation effects, such as frequency-selective fading, multipath, and doppler effect (vehicles with mobile cellular units are in motion with respect to the cell site antenna), diversity reception is often implemented. Diversity refers to the practice of employing more than one antenna for receiving signals, transmitting signals, or both. Receive diversity is the most common type in use for cellular system, and even mobile installations sometimes employ diversity.

Spatial diversity is the kind of diversity most often encountered, and many vehicles can be seen on the roadways with two cellular antennas displaced from one another. If one antenna is in a fade condition, the other antenna may not be, and an electronic circuit within the cellular unit typically switches back and forth between these two antennas, sampling relative signal strength in order to decide which antenna to use.

Similar spatial diversity methods are used at the cell site end. But spatial diversity alone does not address all of the propagation anomalies encountered in cellular systems. Polarization diversity, especially when combined with spatial diversity, can provide superior cell site performance.

Polarization diversity is the term used to describe a system in which multiple antennas with different polarizations are used. Generally, there are separate antennas provided for receiving, with only one for transmitting, but multiple transmit antennas have also been used in cellular systems to overcome particular propagation problems. Relative signal strength, as discussed above, is one criterion used for antenna selection, but various voting methodologies, as are known in the art, have also been effectively used.

In order to achieve both polarization diversity and spatial diversity effectively in a cellular system, a specially arrayed composite antenna that includes antenna elements of different polarizations would be a highly desirable tool. Such an antenna is illustrated in FIG. 6(*a*)

The composite antenna 600 depicted in FIG. 6(*a*) is constructed on a ground plane formed by a conductive means such as plate 605. Preferably, the conductive plate 605 is formed from 1/16 inch aluminum sheet, but other materials, and other thicknesses, would also function in this application.

The composite antenna 600 includes a vertically polarized antenna array formed by a plurality of vertically polarized antennas 606 mounted to the conductive plate 605. The conductive plate 605 functions as a ground plane for the antennas 606. As can be seen in FIG. 6(*a*), the antennas 606 of the vertically polarized antenna array share a common orientation; that is, they are at least parallel to one another. In fact, in FIG. 6(*a*), the antennas 606 of the vertically polarized antenna array are shown as being collinear, but a slight offset from this collinear geometry is permissible as long as the antennas 606 remain parallel to one another, and displaced from one another end to end. The antennas 606 of the vertically polarized array are fed through a transmission line transformer 609 of conventional design, so that the elements will be fed in phase with one another.

FIG. 6(*a*) also shows a horizontally polarized antenna array that includes a plurality of subarrays 601. Each of these subarrays 601 includes a driven dipole element 602 and a pair of collinear parasitic dipole elements 603 that are disposed on opposite sides of the driven dipole element 602. The parasitic dipole elements 603 are spaced about one-half wavelength away from the driven dipole element 602, as measured from the center of the driven dipole element 602 to the center of the parasitic element 603. The driven elements 602 of each horizontally polarized subarray 601 are also fed in phase through a transmission line transformer 604 of conventional design. The orientation of the elements of the horizontally polarized antenna array is orthogonal to the orientation of the antennas of the vertically polarized array. More about the geometry of these antenna elements will be introduced in subsequent sections.

FIG. 6(*b*) is a side elevational view of the composite antenna array. Each of the antennas 606 of the vertically polarized antenna array is actually a log periodic dipole array that includes a first log periodic dipole element 607 and a second, longer log periodic dipole element 608 that is disposed between the first element 607 and the ground plane 605. The longer dipole element 608 is approximately one-half wavelength in electrical length at the operating frequency. A log periodic dipole array, as is well known in the art, is a system of driven dipole elements of different lengths.

In the embodiment illustrated, there are four antennas 606 in the vertically polarized array, but other configurations, such as one including eight antennas, may prove advantageous in determining composite antenna gain and shaping the radiation pattern for specific uses. FIG. 6(*f*) shows two composite antenna arrays 600 arranged in an end-to-end relationship to yield a larger composite antenna with eight antennas in the vertically polarized antenna array, and eight subarrays in the horizontally polarized antenna array.

FIG. 6(*c*) is an end elevational view of the composite antenna array that more closely illustrates the geometry of the elements in a horizontally polarized subarray 601. As will be noted from an inspection of the figure, each of the driven dipole elements 602 includes opposing arms 610, 611. Each of these opposing arms 610, 611 is approximately one-quarter wavelength long, electrically, at the subarray operating frequency.

Figure 9:
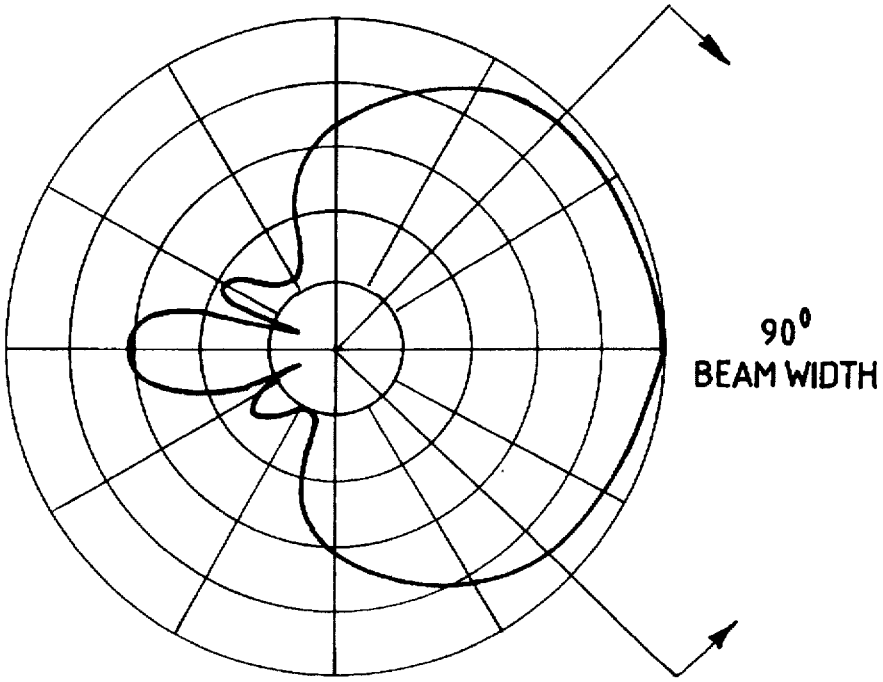
FIG. 9 is a radiation pattern depicting E-plane 3 dB beam width for one embodiment of the horizontally polarized antenna array.

In the illustrated embodiment, the opposing arms 610,611 lie in a plane that is parallel to the ground plane 605. With the arms 610,611 of the driven dipole element 602 disposed at the angle illustrated, the resulting E-plane horizontal beam width is approximately 90 degrees, as shown by the radiation pattern of FIG. 9. This beam width is measured at the 3 dB points, and is typical of the composite array when four horizontally polarized subarrays, as shown in FIG. 6(*a*), are employed. Other arrangements are also advantageous, and will be discussed in more detail subsequently.

Each of the parasitic dipole elements 603 also includes opposing arms 612, 613 that are inclined toward the ground plane 605 such that the opposing arms 612, 613 are perpendicular to one another. The opposing arms 612, 613 of the parasitic dipole elements 603 are also approximately one-quarter wavelength in electrical length at the operating frequency.

Figure 10:
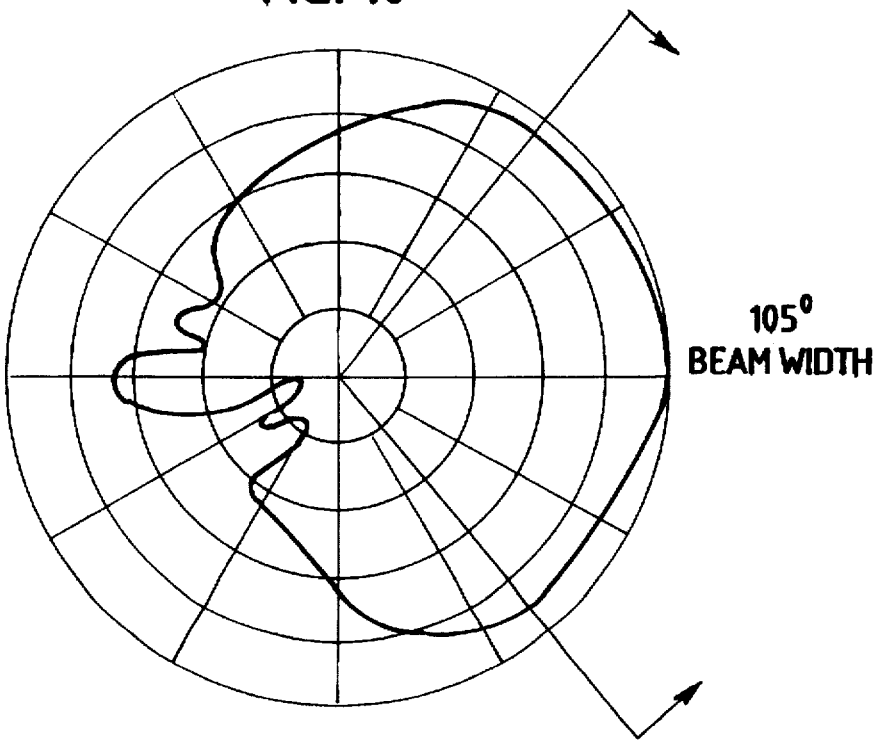
FIG. 10 is a radiation pattern depicting E-plane 3 dB beam width for another embodiment of the horizontally polarized antenna array.

FIG. 6(*d*) is an end view of the composite antenna array that shows a different geometry for the driven dipole element 602 of a horizontally polarized subarray 601. In the illustrated embodiment, the opposing arms 610, 611 of the driven dipole element 602 are inclined toward the ground plane 605 such that the opposing arms 610, 611 form an angle of 120degrees with one another. In a composite antenna employing four horizontally polarized subarrays, this driven dipole geometry yields an E-plane horizontal 3 dB beam width of approximately 105 degrees, as illustrated by the radiation pattern of FIG. 10.

Figure 11:
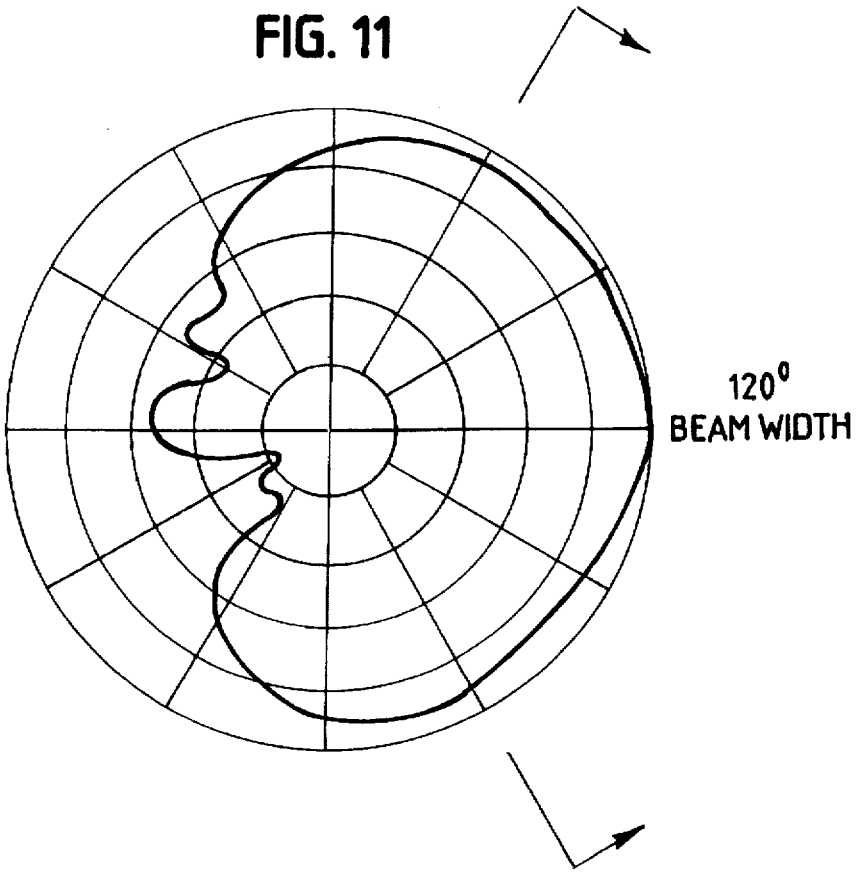
FIG. 11 is a radiation pattern depicting E-plane 3 dB beam width for yet another embodiment of the horizontally polarized antenna array.

FIG. 6(*e*) shows yet another configuration of driven dipole elements 602. In this embodiment, the opposing arms 610, 611 are inclined toward the ground plane 605 so that the opposing arms 610, 611 are perpendicular to one another. With the illustrated configuration, a horizontal E-plane 3 dB beam width of 120 degrees is achievable, as illustrated in FIG. 11.

The effects of mutual coupling (the effect that elements of an array, including parasitic elements, have on each other) are controlled by configuring the parasitic elements such that each of the opposing arms of the parasitic dipole elements is at an angle of 45° to the ground plane. The net effect is that the horizontal beam width (the 3 dB beam width) is extended by the parasitic elements when used in conjunction with different driven element geometries.

The net effect of an array of individual driven elements, whether or not combined with parasitics, is determined by a complex interrelationship of interference patterns, some of which result in enhancement of a particular field, and some others in cancellation. The induction field of the array, which is the field in close proximity to the antenna, is also significant in array dynamics. In the inventive configuration, the parasitic elements, with their unique shape factor, act to shape the radiation pattern into the desired beam width.

Since the parasitic elements are in relatively close proximity to the driven element (about one-half wavelength away), some of the electric fields generated by the driven element reach the parasitics, inducing currents on the surfaces of the parasitic elements. These induced currents, of course, lead to additional radiation into free space.

In order to broaden the azimuthal pattern, the induced currents on the parasitic elements must be out of phase with respect to the current on the driven element. This is why the parasitic elements are spaced one-half wavelength away. The azimuthal pattern is further controlled and enhanced by adjusting the amount of the induced currents on the parasitics. This can be achieved by varying the angle that the opposing arms of the driven dipole element make with the ground plane, and through the use of resistive devices on the parasitic elements.

It has been observed that in order to achieve a half-power (3 dB) beam width of about 90 degrees, the induced currents on the parasitic elements should be about 18 dB below the current level on the driven element. For a beam width of 105 degrees, the parasitic currents should be down about 14 dB from the driven element level, and for a 120 degree beam width, the induced currents on the parasitic elements should be about 11 dB below the current level on the driven element.

FIGS. 7(*a*) and 7(*b*) show how the antennas 606 of the vertically polarized antenna array are constructed. Identical element halves 701 are formed from a suitable conductive material. In the preferred embodiment, these element halves 701 are formed from 0.063 inch thick No. 260 cartridge brass that is subsequently silver plated to a thickness of 0.0003 inch. One end of the element half 701 is bent to form a small perpendicular portion 702, and a hole 703 is made therethrough for mounting to the antenna ground plane. Two opposing element halves 701 are required to form each antenna of the vertical array.

FIGS. 8(*a*)–8(*c*) serve to illustrate construction of both the driven and parasitic elements of the horizontally polarized array. Only the construction of a parasitic dipole element is shown, but construction of a driven dipole element is exactly analogous, except for one minor detail that will be discussed below.

Each parasitic dipole element 603 is constructed from a suitable conductive material, preferably from 0.063 inch thick No. 260 cartridge brass, with a silver plating of about 0.0003 inch. In the preferred embodiment, the element 603 is constructed by bending a single piece of brass, although other construction techniques would work equally well. The single detail (apart from the angle formed between opposing arms) in which the parasitic elements differ from the driven element is the installation of a resistor 801 between the opposing arms 612, 613. The resistor value is chosen in conjunction with the geometry of the driven element to achieve the desired 3 dB horizontal E-plane beam width for the horizontally polarized antenna array. For beam widths of 90 degrees or 105 degrees, a value for resistor 801 between 45 and 55 ohms is appropriate. For a 120 degree beam width, the resistor value should be between 25 and 35 ohms.

Figure 12A:
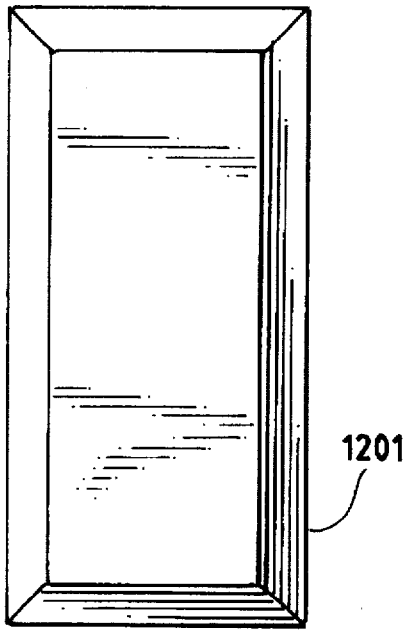
FIG. 12(*a*) is a top plan view of a protective cover.
Figure 12B:
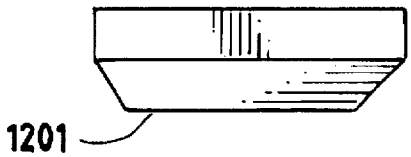

FIG. 12(*a*) depicts a protective cover or radome for the antenna array that is designed to mate with the conductive ground plane (605 in FIG. 6(*a*)) to protect the antenna assembly from damage due to impact or weather conditions. FIG. 12(*b*) is a side elevational view of the protective cover 1201. Preferably, the cover 1201 is formed from an insulating material that is relatively transparent to electromagnetic waves. ABS plastic is used for the protective cover 1201 in the preferred embodiment of the invention.

Figure 13A:
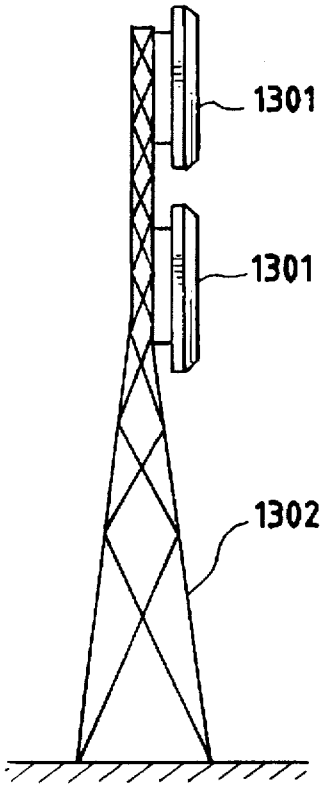
FIGS. 13(*a*) and 13(*b*) depict the composite antenna array in accordance with the present invention as supported by an antenna support structure.
Figure 13B:
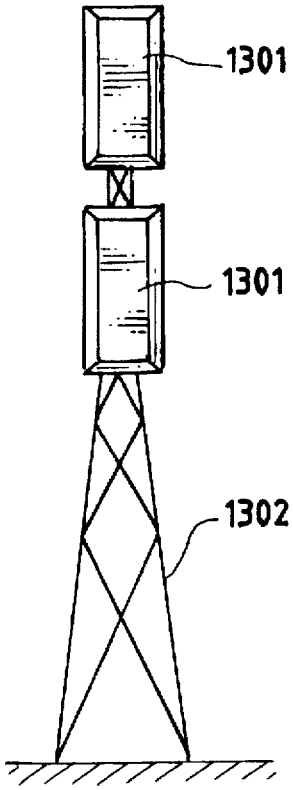

FIG. 13(*a*) shows the composite antenna array of the present invention supported by an antenna support structure in this case a tower, in an operating orientation. In the preferred embodiment, the composite antenna 1301 is supported for operation so that the ground plane is perpendicular to the Earth's surface. For proper operation, the composite antenna is supported such that its length is also perpendicular to the earth's surface, as shown in FIG. 13(*b*). In order to implement both spatial and polarization diversity, two antennas 1301 are mounted one above the other, as illustrated. Vertical spacing between individual antenna arrays is selected for optimum diversity performance at the frequency of interest.

Figure 14:
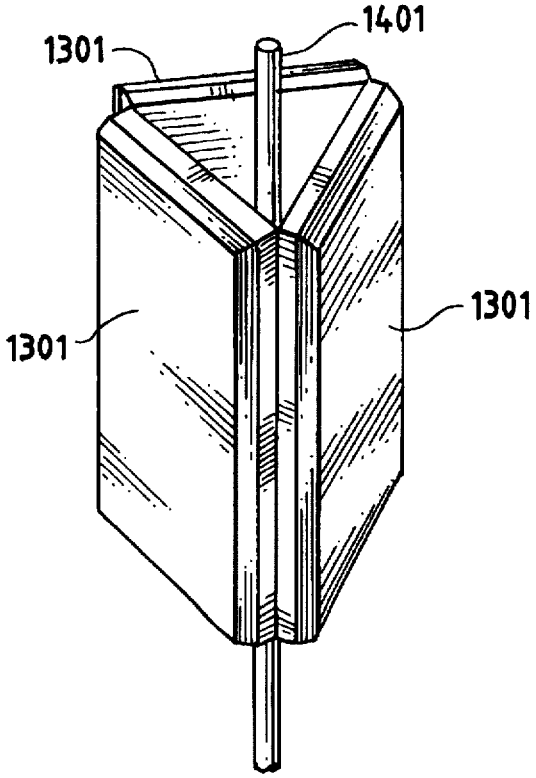
FIG. 14 is a perspective view of an antenna support structure illustrating disposition of composite antenna arrays for coverage of a three-sector cell.

FIG. 14 illustrates the disposition of composite antenna arrays 1301 for coverage of a cell that has been subdivided into three 120 degree sectors. The antenna arrays 1301 are disposed 120 degrees apart. Of course, multiple, vertically stacked arrays may be disposed at each antenna location, as shown in FIGS. 13(*a*) and 13(*b*). For optimum operation in both spatial diversity and polarization diversity, both the horizontally and vertically polarized arrays may be used for receiving, while the vertically polarized array alone is used for transmitting. Various voting arrangements conventional in the art may be used to implement spatial diversity between the composite antenna arrays within each sector.

There have been described herein a horizontally polarized antenna array and method for extending E-plane beam width that are relatively free from the shortcomings of the prior art. It will be apparent to those skilled in the art that modifications may be made without departing from the spirit and scope of the invention. Accordingly, it is not intended that the invention be limited except as may be necessary in view of the appended claims.

What is claimed is:

1. An antenna array comprising:

a driven dipole element mounted to a conductive means forming a ground plane, the driven dipole element having opposing arms; and a pair of collinear parasitic dipole elements disposed on opposite ends of the driven dipole element, the parasitic dipole elements having opposing arms inclined toward the ground plane such that the opposing arms of each parasitic dipole element are perpendicular to one another.

2. The antenna array of claim 1, wherein the antenna array operates at an operating frequency, and each of the opposing arms of the driven dipole element is approximately one-quarter wavelength in electrical length at the operating frequency.

3. The antenna array of claim 1, wherein the antenna array operates at an operating frequency, and each of the opposing arms of the parasitic dipole elements is approximately one-quarter wavelength in electrical length at the operating frequency.

4. The antenna array of claim 1, wherein the antenna array operates at an operating frequency, and each parasitic dipole element is spaced approximately one-half electrical wavelength from the driven dipole element.

5. The antenna array of claim 1, wherein the opposing arms of each parasitic dipole element are connected by a resistor.

6. The antenna array of claim 5, wherein the resistor has a value between 45 and 55 ohms.

7. The antenna array of claim 5, wherein the resistor has a value between 25 and 35 ohms.

8. The antenna array of claim 1, wherein the antenna array comprises a horizontally polarized antenna array having an E-plane 3 dB beam width of approximately 90 degrees.

9. The antenna array of claim 1, wherein the opposing arms of the driven dipole element are inclined toward the ground plane to form an angle therebetween.

10. The antenna array of claim 9, wherein the angle formed between the opposing arms of the driven dipole element is approximately 120 degrees.

11. The antenna array of claim 10, wherein the antenna array comprises a horizontally polarized antenna array having an E-plane 3 dB beam width of approximately 105 degrees.

12. The antenna array of claim 9, wherein the angle formed between the opposing arms of the driven dipole element is approximately 90 degrees.

13. The antenna array of claim 12, wherein the antenna array comprises a horizontally polarized antenna array having an E-plane 3 dB beam width of approximately 120 degrees.

14. A composite antenna array comprising:

a vertically polarized antenna array including a plurality of vertically polarized antennas mounted to a conductive means forming a ground plane, the vertically polarized antennas sharing a common first orientation;

a horizontally polarized antenna array including a plurality of subarrays, with each of the subarrays comprising:

a driven dipole element mounted to the conductive means forming the ground plane, the driven dipole element having opposing arms inclined toward the ground plane to form an angle therebetween;

a pair of collinear parasitic dipole elements disposed on opposite ends of the driven dipole element, the parasitic dipole elements having arms toward the ground plane such that the opposing arms of each parasitic dipole element are perpendicular to one another; and the driven dipole element and the parasitic dipole elements sharing a common second orientation orthogonal with said first orientation.

15. The composite antenna array of claim 14, wherein each of the antennas of the vertically polarized antenna array comprises a log periodic dipole array.

16. The composite antenna array of claim 14, wherein the vertically polarized antenna array comprises four vertically polarized antennas.

17. The composite antenna array of claim 14, wherein the vertically polarized antenna array comprises eight vertically polarized antennas.

18. The composite antenna array of claim 14, wherein the horizontally polarized antenna array comprises four subarrays.

19. The composite antenna array of claim 14, wherein the horizontally polarized antenna array comprises eight subarrays.

20. The composite antenna array of claim 14, further including an antenna support structure for supporting the antenna array in an operating orientation.

21. The composite antenna array of claim 20, wherein the operating orientation comprises an orientation in which the ground plane is substantially perpendicular to the earth's surface.

22. A method for extending 3 dB E-plane beam width of a horizontally polarized antenna array, the method comprising the steps of:

(a) mounting a driven dipole element to a conductive means forming a ground plane, the dipole element having opposing arms forming an angle therebetween;

(b) disposing a pair of collinear parasitic dipole elements on opposite ends of the driven dipole element, the parasitic dipole elements having opposing arms inclined toward the ground plane such that the opposing arms of each parasitic dipole element are perpendicular to one another; and (c) decreasing the angle between the opposing arms of the driven dipole element to extend 3 dB E-plane beam width of the antenna array while controlling mutual coupling.

23. The method in accordance with claim 22, wherein the opposing arms of the parasitic dipole elements are connected by an electrical resistance.

24. The method in accordance with claim 23, further comprising the step of decreasing the electrical resistance to extend 3 dB E-plane beam width while controlling mutual coupling.

* * * * *

UNITED STATES PATENT AND TRADEMARK OFFICE

CERTIFICATE OF CORRECTION

PATENT NO. : 5,629,713

DATED : May 13, 1997

INVENTOR(S) : Peter Mailandt et al.

It is certified that error appears in the above-indentified patent and that said Letters Patent is hereby corrected as shown below:

IN THE CLAIMS:

Claim 14, Col. 10, line 58, change "having arms toward" to -- having opposing arms inclined toward --.

Signed and Sealed this

Fifteenth Day of July, 1997

*Attest:*

*Attesting Officer*

BRUCE LEHMAN

*Commissioner of Patents and Trademarks*